US008550093B2

(12) United States Patent
Saint-Girons et al.

(10) Patent No.: US 8,550,093 B2
(45) Date of Patent: Oct. 8, 2013

(54) FLEXIBLE PACKAGE FOR TOBACCO MATERIAL

(75) Inventors: Sandrine Saint-Girons, Pully (CH); Dan Brady, Berkshire (GB); Steve Sayers, Buckinghamshire (GB)

(73) Assignee: Philip Morris USA Inc., Richmond, VA (US)

( * ) Notice: Subject to any disclaimer, the term of this patent is extended or adjusted under 35 U.S.C. 154(b) by 56 days.

(21) Appl. No.: 12/981,303

(22) Filed: Dec. 29, 2010

(65) Prior Publication Data

US 2011/0174325 A1 Jul. 21, 2011

(30) Foreign Application Priority Data

Dec. 30, 2009 (EP) ..... 09252922

(51) Int. Cl.
*A24F 47/00* (2006.01)

(52) U.S. Cl.
USPC ..... 131/347; 53/397; 53/399; 53/414; 53/415; 53/417; 426/130; 426/122; 426/123; 426/112; 426/115; 229/87.05; 229/87.08; 229/87.09; 229/87.11; 206/551; 206/265; 131/366

(58) Field of Classification Search
None
See application file for complete search history.

(56) References Cited

U.S. PATENT DOCUMENTS 2,302,784 A 11/1942 Lytton et al.

FOREIGN PATENT DOCUMENTS

| | | | |
|---|---|---|---|
| DE | 2 309 361 | A1 | 9/1973 |
| DE | 7634644 | U1 | 3/1977 |
| DE | 84 29 070 | U1 | 11/1984 |
| GB | 1427091 | A | 3/1976 |
| WO | WO 2008/135468 | A1 | 11/2008 |

OTHER PUBLICATIONS

International Search Report and Written Opinion mailed Apr. 14, 2011 for PCT/EP2010/007870.
Search Report dated May 12, 2010 for European Patent Application No. 09 25 2922.
International Preliminary Report on Patentability issued Jul. 4, 2012 for PCT/EP2010/007870.

*Primary Examiner* — Richard Crispino
*Assistant Examiner* — Phu Nhuyen
(74) *Attorney, Agent, or Firm* — Buchanan Ingersoll & Rooney PC

(57) ABSTRACT

A package for tobacco material includes a portion of tobacco material, a wrapper enclosing the portion of tobacco material, a rigid base portion and at least one resealable adhesive label sealing the wrapper around the portion of tobacco material. The wrapper is formed of a flexible sheet material. The package may include an opening strip defined by one or more lines of weakness in the wrapper.

5 Claims, 2 Drawing Sheets

FLEXIBLE PACKAGE FOR TOBACCO MATERIAL

CROSS REFERENCE TO RELATED APPLICATION

This application corresponds to and claims priority under 35 U.S.C. §119 to European Application No. 09252922.1, filed Dec. 30, 2009, the entire content of which is hereby incorporated by reference.

WORKING ENVIRONMENT

Loose tobacco material can be sold in rigid boxes or tins. In particular, smokeless tobacco products such as snuff and snus can be sold in cylindrical metal tins or plastic containers having a box portion and removable lid portion. After use and once emptied, the containers are can be disposed of and a new, full container can be purchased.

Relatively rigid refill units for the rigid boxes or tins used for loose tobacco material are known. For example, WO-A-2008/135468 discloses a refill unit for a moist smokeless tobacco product including a base portion and a lid portion removably attached to the base portion defining a storage space.

It would be desirable to provide an improved form of packaging for tobacco material that is more ecological and can be produced and disposed of in a way that has a reduced impact on the environment. It would also be desirable to provide an improved form of packaging for tobacco material that is more efficient to fill and produce than existing, rigid containers. In particular, it would be desirable to provide an improved form of refill packaging for tobacco material that can be readily inserted into existing containers. Furthermore, it would be desirable to provide a packaging of this type that may be adapted for refilling a variety of tobacco container types and shapes.

SUMMARY OF SELECTED FEATURES OF THE PREFERRED EMBODIMENT

In a preferred embodiment, a package includes a portion of tobacco material, a wrapper enclosing the portion of tobacco material, a rigid base portion having a curved outer edge, and at least one resealable adhesive label sealing the wrapper around the portion of tobacco material. Preferably, the wrapper is formed of a flexible sheet material.

In the preferred embodiment, the package also includes a rigid side wall extending around the package. Preferably, at least one of the rigid base portion and the rigid side wall is inside the wrapper. Also preferably, the wrapper includes one or more lines of weakness defining an opening strip extending at least part way around the package. Moreover, the opening strip includes a protruding tab portion at an end thereof.

Preferably, the package can also include two opposed adhesive labels sealing opposed sides of the wrapper. Also preferably, the flexible sheet material is made of wax paper or glassine. Moreover, the rigid base portion is circular in shape.

In the preferred embodiment, the package is a refill package for inserting into a rigid container. Preferably, the refill package is for inserting into a snus can.

BRIEF DESCRIPTION OF THE DRAWINGS

The invention will be further described, by way of example only, with reference to the accompanying drawings wherein like reference numerals are applied to like elements and wherein.

DETAILED DESCRIPTION

Figure 1:
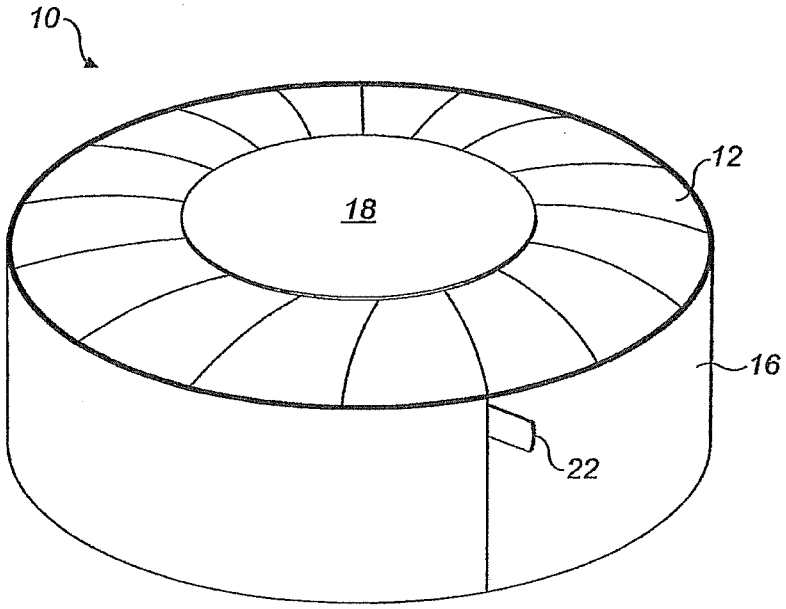
FIG. 1 shows a filled package according to the present invention, prior to opening.

The present invention relates to a flexible package filled with tobacco material. The invention finds particular application as a package suitable for use in refilling a rigid container and in particular, as a snus refill package for a snus can.

In a preferred embodiment, a package of tobacco material includes a portion of tobacco material, a wrapper enclosing the portion of tobacco material, a rigid base portion having a curved outer edge, and at least one resealable adhesive label sealing the wrapper around the portion of tobacco material. Preferably, the wrapper is formed of a flexible sheet material.

The package is a novel package that offers a different approach to the packaging of loose tobacco material than existing containers. Loose tobacco material, such as snus, is typically packaged in rigid, structured containers having a defined shape. In the preferred embodiment, the package uses a flexible sheet material to wrap the loose tobacco material and this offers a number of benefits, both to the environment and the manufacturer. As described in more detail below, the package is more ecological and more efficient to produce, fill and transport than existing, rigid containers.

Preferably, the wrapper enclosing the tobacco material is formed of a sheet material that is flexible and can be readily wrapped or folded around the portion of tobacco material in a simple process step. The wrapping step can be readily adapted to different size portions of tobacco material. Since the wrapper is flexible, it can enclose the tobacco material without leaving significant air space within the package. This is advantageous, since it enables the overall package size and the amount of packaging material to be minimised. In addition, the reduction of air space within the package optimises the freshness of the tobacco.

After opening, once some of the tobacco material has been used, the package is sufficiently adaptable that the wrapper can still be folded tightly around the remaining tobacco material without significant air space within the package. This helps to maintain freshness after opening and also reduces the size of the packaging so that it occupies less space, for example, in a pocket or bag.

The form of the package is such that the wrapper can be produced from a simple sheet of material, without the need for any seams or seals to be incorporated. This greatly simplifies the production process for the package compared to processes for producing rigid, molded containers. Despite the lack of structure in the wrapper, the arrangement of folds and the use of one or more resealable adhesive labels allows the package to be easily and conveniently filled with loose tobacco material and sealed closed The inclusion of the rigid base portion provides a structural element to the package, which makes the package more robust and provides some protection to the tobacco material. The rigid base portion may also facilitate the filling and folding processes in the production of the package. In particular, the provision of a rigid base portion having a curved outer edge may simplify the process of folding the outer wrapper around the tobacco material since there will typically be more flexibility in the position and form of the folds in the outer wrapper than if the rigid base portion had straight edges and corners.

The package is significantly less bulky than conventional rigid containers and requires less material to package the same amount of tobacco material. Therefore, the package not only provides a more efficient and cost effective way to package tobacco material, but it also cuts down on the amount of waste material. The wrapper of the package can also advantageously be formed from a recyclable or biodegradable sheet material such that the invention provides a more ecological form of packaging.

The wrapper and rigid base portion can be stored and transported in a flat state until it is desired to fill the package with the tobacco material. This advantageously reduces transport costs and also provides the producer of the tobacco material with greater flexibility in the final shape and form of the package.

The package may be used as an alternative to existing, rigid containers for tobacco material. In this case, the package provides a stand alone container that is adapted to store the tobacco material before use as well as between uses, and to dispense the tobacco material.

Preferably, the package is also particularly suitable for use as a refill package for filling a used, empty container with a new, fresh portion of tobacco material. Unlike in the refill units of the prior art, the use of a flexible material to form the package provides flexibility because the shape of the filled package is sufficiently adaptable that the package can be inserted into a variety of shapes and sizes of rigid containers.

The wrapper of package may be formed of any suitable, flexible sheet material including, but not limited to, paper, wax paper, glassine, metallized paper, metal foil or plastic film. Where the wrapper is a plastic film, the film is preferably based on one or more polyolefins. For example, the wrapper may be a polyethylene or polypropylene film. The wrapper may be formed of a transparent or opaque sheet material. Preferably, the wrapper is formed of a recyclable or biodegradable material.

Preferably, the wrapper is formed of a material to which printing can be applied and the wrapper may have brand, advertising, promotional or product information applied thereto. In the case of a refill package, the brand, advertising, promotional or product information applied to the wrapper may be the same as, or different to the information printed directly onto the exterior surface of the rigid container intended to be refilled.

For certain types of tobacco material, it may be beneficial to use a sheet material that acts as a moisture barrier to prevent the loss of moisture from the tobacco material within the package.

Preferably, the wrapper is pre-folded such that it can be more easily and more uniformly folded or assembled around the tobacco material. The fold lines may also be used to provide the package with a more defined shape, if desired, without making the package more rigid.

In the preferred embodiment, the wrapper of the package is held in place around the tobacco material by the at least one resealable adhesive label, such that the package is sealed prior to opening and the tobacco material is protected. This ensures that the tobacco material remains fresh until the package is opened. Preferably, the at least one resealable adhesive label is the only means for sealing the wrapper and no additional adhesive or glue is required in order to secure the wrapper in place around the portion of tobacco material. This advantageously simplifies the step of sealing the package during manufacture.

The reclosure of the packaging material after opening may advantageously help to retain freshness of the tobacco material, in particular, where the package is intended as a stand alone container providing an alternative to a conventional, rigid container. After the initial opening of the package the resealable adhesive label can be used to reseal the wrapper between uses. In certain embodiments of the present invention, the package includes two opposed adhesive labels at opposed sides of the package.

The one or more adhesive labels may be formed or any suitable material and may be printed with brand, promotional or product information instead of or in addition to any printing on the wrapper. The shape and size of the adhesive labels may be adapted to suit the format of the wrapper and in the case of a refill package, the size and shape of the rigid container to be refilled by the package.

The rigid base portion of packages has a curved outer edge. The rigid base portion may, for example, be substantially circular, oval or elliptical in shape. Typically, the shape of the rigid base portion will approximately define the overall cross section and shape of the filled package. The exact size and shape of the rigid base portion can be varied depending on the desired size and shape of the filled package. In the case of a refill package, the shape and size of the rigid base portion is preferably selected to reflect the shape of the rigid container into which it is intended to insert the refill package. For example, where the package is a snus refill package, the rigid base portion is preferably a rigid circle or disc such that the refill package takes on an approximately circular cylindrical form and can readily be inserted into a circular cylindrical snus can.

The rigid base portion may be provided outside the wrapper, but is preferably provided inside the wrapper between the wrapper and the tobacco material.

In addition to the rigid base portion, the package may optionally include a rigid side wall that extends at least part way around the package. For example, an annular rigid side wall may be provided in order to give the package a generally circular and/or cylindrical form. In the case of a refill package, this enables the package to be configured to fit inside the rigid container to be refilled.

The inclusion of a rigid side wall in addition to the rigid base wall provides the package with a more defined and rigid form which may be desirable, for example, where the package is intended as a stand alone package to replace existing rigid containers, rather than a refill package. The inclusion of a rigid side wall may advantageously further protect the tobacco material inside the package from damage due to crushing during storage and transport. However, the rigid side wall may optionally be removed such that the benefits of using a flexible wrapper can still be obtained.

The rigid side wall may be provided inside or outside the wrapper. Where a rigid side wall is provided on the outside of the wrapper, the side wall may be adhered to the wrapper, or may simply fit around the filled wrapper without adhesion. The rigid side wall may optionally be removable from the remainder of the package, so that it can be removed by the consumer, for example, before the package is inserted into a rigid container. This may be advantageous, for example, in the case of a refill package where the size of the rigid side wall does not exactly correspond with the size of the rigid container.

Where a rigid side wall is provided, the rigid base portion and rigid side wall may be separate from each other, or may be connected to each other in some way, or may be integrally formed, as desired.

The rigid base portion and rigid side wall, where present, may be formed of any suitable rigid sheet material including, but not limited to, paper, cardboard, plastic, metal or laminar materials. Preferably, the rigid base portion and rigid side wall, where present, are formed of a recyclable fibrous sheet material such as cardboard. Where the rigid base portion or rigid side wall are provided on the outside of the wrapper, the exterior surfaces thereof are preferably printed with graphics or text, such as for example brand, promotional or product information.

The portion of tobacco material within the package of the present invention may be a defined quantity of loose, combustible tobacco, for example, tobacco for forming cigarettes or for smoking in a pipe. The combustible tobacco material may include cut tobacco plant or a reconstituted tobacco material, or a mixture thereof. Alternatively, the tobacco material may be a smokeless tobacco product, for example, tobacco material for a heated smoking article, chewing tobacco, snuff or snus. The snuff or snus may be pasteurized, or unpasteurized. The coarseness, flavor, nicotine content and moisture content of the snuff or snus may each be selected, as desired. Where oral tobacco products such as snus are provided, the tobacco material may be loose within the package or may optionally be provided in individually wrapped portions, such as pouches. The tobacco material may include one or more additives, such as flavorants or humectants and may be formed of a single type of tobacco, or a blend of different types.

The portion of tobacco material may be any desired quantity or weight but preferably corresponds approximately to the quantity of loose tobacco material in a conventional container. Typically, the quantity of tobacco material will be sufficient for a plurality of uses and preferably the size or weight of the portion will be indicated on the outer surface of the wrapper.

Access to the tobacco material within the package may be gained by opening the wrapper surrounding the tobacco material through the removal or release of the at least one resealable adhesive label. The at least one resealable adhesive label is preferably provided at the top of the package. The wrapper can be resealed between uses by resealing the at least one resealable adhesive label.

Alternatively, or in addition, the wrapper may be provided with one or more lines of weakness defining an opening strip extending at least part way around the package. In order to open the package for the first time, the consumer can remove the opening strip from the wrapper thereby providing an opening in the wrapper through which the tobacco material can be accessed. Preferably, where an opening strip is provided, a protruding tab portion is provided at one end thereof. The tab of the opening strip protrudes from the surrounding surface of the package and is therefore more easily grasped by the consumer. The opening strip, where present, is preferably positioned such that is can be accessed and removed when the package has been inserted into a rigid container. Where a rigid side wall is provided, it may be necessary to remove the rigid side wall before the opening strip can be removed, or the opening strip may be provided at a position in the wrapper that is not covered by the rigid side wall.

The opening strip may be adapted such that it is removable from the remainder of the wrapper. Alternatively, the opening strip may extend only part of the way around the wrapper and may be adapted such that it remains attached to the wrapper after opening. In certain embodiments, the end of the opening strip may be provided with a resealable adhesive, such that the opening strip can be reclosed. In this case, the adhesive on the opening strip may help to reseal the package between uses.

Filled packages may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where packages are over wrapped, the over wrapper may include a tear tape. In addition, the over wrapper may be printed with images, consumer information or other data.

Figure 3:
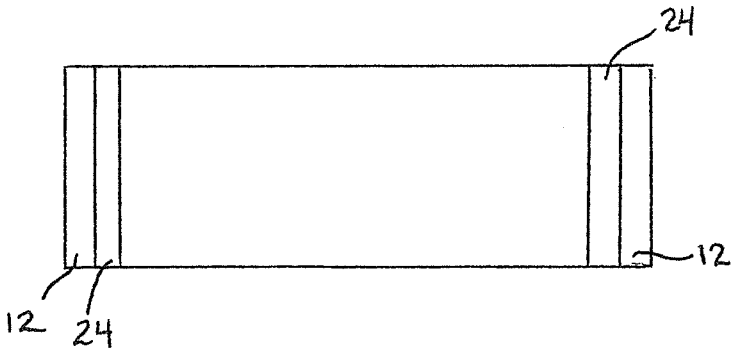
FIG. 3 shows a cross-sectional view of the package of FIG. 1.

As shown in FIG. 1, the package 10 contains a plurality of snus pouches and includes a flexible wrapper 12, a rigid base portion 24 (shown in FIG. 3) within the flexible wrapper 12, a rigid side wall 16, a top resealable adhesive label 18 and a bottom adhesive label (not visible). The package is generally cylindrical in shape, with a circular rigid base portion and an annular rigid side wall 16 of constant height having a generally circular cross section corresponding to the shape of the rigid base portion. It is suitable for use as a refill package for refilling a cylindrical snus can.

Figure 2:
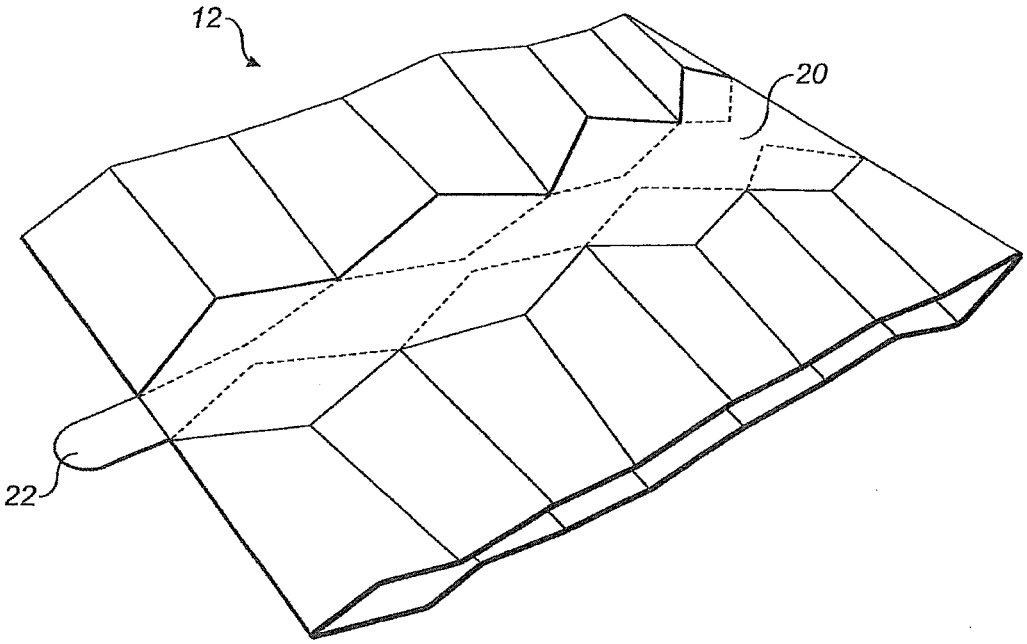
FIG. 2 shows a wrapper for forming the package of FIG. 1.

FIG. 2 shows the flexible wrapper 12 prior to assembly of the package 10. As can be seen from FIG. 2, the wrapper 12 is formed of a rectangular strip of flexible sheet material that has been formed into an endless band. The flexible wrapper 12 is provided with an arrangement of fold lines (shown as solid lines in FIG. 2) to facilitate folding of the top and bottom ends of the flexible wrapper 12. In order to assemble the package 10, the rigid base portion 24 (shown in FIG. 3) is placed inside the endless band of the flexible wrapper 12 shown in FIG. 2 and the bottom of the flexible wrapper 12 is folded around the circular rigid base portion and secured with the bottom adhesive label. The partially folded flexible wrapper 12 with the circular rigid base portion 24 contained therein is then placed inside the annular rigid side wall 16 and the snus pouches are placed inside the flexible wrapper 12. The top of the flexible wrapper 12 is then folded over the snus pouches and sealed at the top end with the top resealable adhesive label 18.

As can be seen from FIGS. 1 and 2, the flexible wrapper 12 includes an opening strip 20 which runs around the center of the endless band of the flexible wrapper 12. Once the package 10 is assembled, the opening strip 20 is positioned towards the upper edge of the package 10. The opening strip 20 is defined by lines of perforation in the flexible wrapper 12 and is provided at one end with a protruding tab 22 to facilitate opening. The opening strip 20 extends all the way around the package 10 such that upon removal of the opening strip 20, the entire upper portion of the flexible wrapper 12 becomes separated from the lower portion thereof and can be disposed of.

In order to access the snus pouches within the package 10, the consumer can either remove the top resealable adhesive label 18 and unfold the top of the flexible wrapper 12 to remove the snus pouches from the top of the package 10 or can remove the opening strip 20 to detach the top part of the flexible wrapper 12. The former opening step may be preferred if it is desired to reseal the wrapper 10 with the top resealable adhesive label 18.

If desired, the package 10 may be placed within an empty snus can. The package 10 is inserted into the body portion of the snus can with the top resealable adhesive label 18 at the top of the package 10. If desired, the annular rigid side wall 16 can be detached from the remainder of the package 10 prior to insertion of the package 10 into the snus can. The size and shape of the refill package 10 are such that the package 10 fits within the snus can and the lid of the snus can still be put in place.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions.

While the foregoing describes in detail a preferred flexible package and method with reference to a specific embodiment thereof, it will be apparent to one skilled in the art that various changes and modifications may be made to the flexible package and equivalents method may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. A package comprising:

a portion of tobacco material;

a wrapper enclosing the portion of tobacco material;

a rigid base portion having a circular outer edge;

at least one resealable adhesive label sealing the wrapper around the portion of tobacco material; and a rigid side wall extending around an outside of the wrapper, wherein the wrapper is formed of a flexible sheet material, wherein the wrapper includes one or more lines of weakness defining an opening strip extending at least part way around the package, and the opening strip includes a protruding tab portion at an end thereof.

2. The package of claim 1, wherein the rigid base portion is inside the wrapper.

3. The package of claim 1, further including two opposed adhesive labels sealing opposed sides of the wrapper.

4. The package of claim 1, wherein the flexible sheet material is made of wax paper or glassine.

5. The package of claim 1, wherein the package is a refill package for inserting into a rigid snus can.

* * * * *